United States Patent [19]

Myers

[11] 3,998,342

[45] Dec. 21, 1976

[54] COUNTERWEIGHT ATTACHMENT MEANS FOR LOADERS AND THE LIKE

[75] Inventor: Jimmy D. Myers, Morton, Ill.

[73] Assignee: Caterpillar Tractor Co., Peoria, Ill.

[22] Filed: Dec. 22, 1975

[21] Appl. No.: 643,430

[52] U.S. Cl. ..... 214/142; 212/49; 280/759

[51] Int. Cl.[2] ..... E02F 3/00

[58] Field of Search ..... 214/127, 138 R, 142, 214/131 A; 280/759, 760; 212/48, 49; 248/325, 364

[56] References Cited

UNITED STATES PATENTS

| | | | |
|---|---|---|---|
| 2,511,692 | 6/1950 | Brown | 280/759 X |
| 3,135,404 | 6/1964 | Pilch | 214/142 |
| 3,533,524 | 10/1970 | Wilcox | 212/49 X |
| 3,635,493 | 1/1972 | Barth et al. | 280/759 |
| 3,788,674 | 1/1974 | Casey | 214/138 R X |
| 3,795,330 | 3/1974 | Jorgensen et al. | 214/142 |

*Primary Examiner*—L. J. Paperner
*Attorney, Agent, or Firm*—Wegner, Stellman, McCord, Wiles & Wood

[57] ABSTRACT

A counterweight structure for use in counterbalancing earthmoving apparatus, such as a loader, having a removable backhoe. The counterweight includes bracket structures for facilitated mounting of the counterweight to different supports carried by the drive machine of the earthmoving apparatus. One of the bracket structures is adapted for temporarily supporting the counterweight on a support portion of a removable section of the earthmoving apparatus, such as the backhoe thereof. The bracket structures are adapted to permit the transfer between the different supports by normal operation of the apparatus whereby a transfer may be effected by a single operator.

10 Claims, 6 Drawing Figures

COUNTERWEIGHT ATTACHMENT MEANS FOR LOADERS AND THE LIKE

BACKGROUND OF THE INVENTION

1. Field of the Invention

This invention relates to earthmoving apparatus and in particular to means for counterbalancing such apparatus.

2. Description of the Prior Art

In one improved form of earthmoving apparatus shown in U.S. Pat. No. 3,788,674, of Robert Casey, owned by the assignee hereof, an earthmoving apparatus is provided with a removable backhoe. The apparatus may further include a conventional front loader bucket or bulldozer blade with the backhoe being removably mounted to the rear portion of the drive machine vehicle.

It has been found that, when the backhoe is removed, it is desirable to provide a counterweight on the rear portion of the drive machine for improved operation of the apparatus as a conventional front loader or bulldozer.

Further, it has been found desirable to provide a counterweight at the front portion of the apparatus when the backhoe is being utilized on the rear portion of the vehicle.

SUMMARY OF THE INVENTION

The present invention comprehends an improved counterweight structure for use in counterbalancing such earthmoving apparatus which is adapted for facilitated installation on a plurality of different supports carried in the apparatus. The counterweight is adapted to be temporarily supported on a removable portion of the apparatus, such as the backhoe mechanism thereof, and is adapted to be installed on the portion of the apparatus normally carrying the backhoe when the backhoe is removed.

The counterweight is adapted to be mounted selectively on a front loader bucket or bulldozer blade by suitable support means associated therewith. The support means may be similar whereby the mounting bracket means of the counterweight is adapted for installation selectively on the loader bucket or bulldozer blade support means. The bucket loader or bulldozer blade support means may be similar to the means for supporting the backhoe on the rear portion of the vehicle and, thus, the counterweight mounting bracket means is similarly adaptable for mounting thereon upon removal of the backhoe from the vehicle.

A second mounting bracket means carried by the counterweight is adapted to be removably temporarily carried by support means on the backhoe made available upon removal of the backhoe from the vehicle.

The counterweight may further be provided with suitable positioning stop means for use in controlling the disposition of the counterweight on the bucket and bulldozer blade support means.

The counterweight structure of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figures 1, 2, 3, 4, 5, 6:
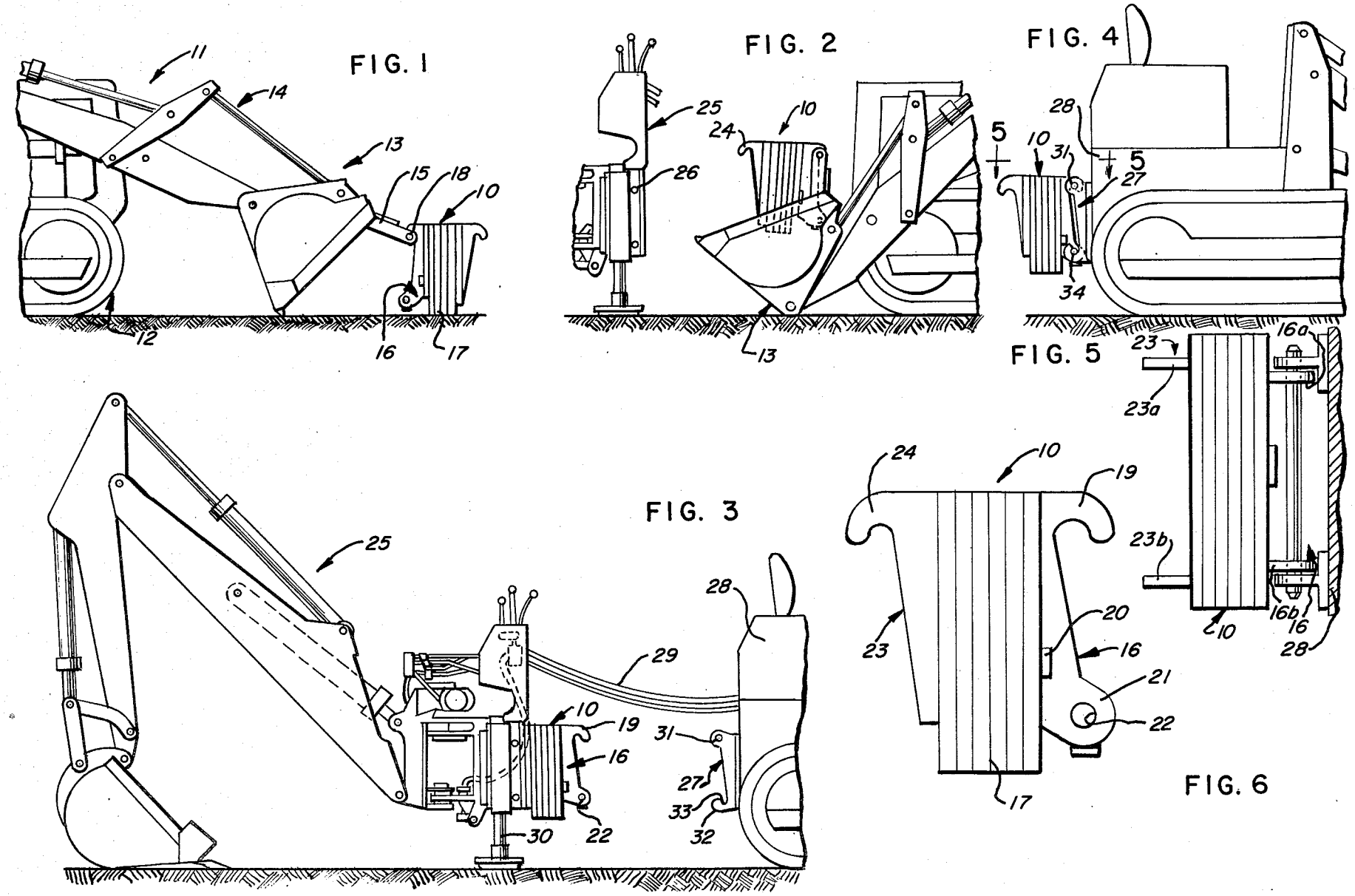
FIG. 1 is a fragmentary side elevation of an earthmoving apparatus provided with a counterweight structure embodying the invention.
FIG. 2 is a fragmentary side elevation illustrating a step in the transfer of the counterweight from a front earthmoving structure of the apparatus to a temporary support on a removable earthmoving structure of the apparatus.
FIG. 3 is a fragmentary side elevation illustrating a further step in mounting the temporarily supported counterweight to a support on the rear portion of the apparatus.
FIG. 4 is a fragmentary side elevation illustrating the mounting of the counterweight on the rear portion of the apparatus.
FIG. 5 is a fragmentary horizontal section taken substantially along the line 5—5 of FIG. 4.
FIG. 6 is an enlarged side elevation of the counterweight structure.

In the exemplary embodiment of the invention as disclosed in the drawing, a counterweight structure generally designated 10 is shown to be adapted for use in selectively counterbalancing an earthmoving apparatus generally designated 11, which, in the illustrated embodiment, includes a drive machine generally designated 12 comprising a crawler tractor. The drive machine may be provided with a front earthmoving apparatus generally designated 13, which, in the illustrated embodiment, comprises a loader bucket adapted to be manipulated by suitable mechanism generally designated 14 in a conventional manner.

The earthmoving apparatus alternatively may include a bulldozer blade as the front earthmoving apparatus. The invention comprehends mounting to the front earthmoving apparatus 13 a first support means 15 adapted to removably support a first mounting bracket means generally designated 16 carried by the weight 17 of the counterweight.

More specifically, the support means 15 may include a horizontal support bar 18 which is adapted to be engaged by a downwardly opening book 19 of bracket means 16. The counterweight may further be provided with a stop member 20 subjacent hook 19 adapted to engage the bracket 15 when the front earthmoving structure is raised from the position of FIG. 1 to the normal counterweight carrying position during use of the backhoe attachment.

As further shown in FIG. 6, bracket 19 includes a lower projecting portion 21 having an opening 22.

The counterweight is provided with a second bracket means generally designated 23 extending from the weight portion 17 oppositely relative to bracket means 16. Bracket means 23 further defines a downwardly opening hook 24.

As shown in FIG. 5, bracket means 16 includes a pair of similar brackets **16*a* and 16*b* and bracket means 23 includes a pair of similar brackets 23*a* and 23*b*. Support bar 18 is adapted to extend horizontally so as to support both brackets 16*a* and 16*b* with the counterweight swinging in a clockwise direction thereon. Thus, loader bucket 13 may be swung to receive the counterweight within the bucket, as shown in FIG. 2, in the normal front-mounted arrangement of the counterweight. In this arrangement, the abutment of stop shoulder 20 with the support means 15** stabilizes the counterweight in a slightly forwardly angled disposition, as shown in FIG. 2.

As shown in FIG. 2, the backhoe attachment generally designated 25 may include a support bar 26 which is disposed suitably to receive the hook portion 24 of bracket 23 during a transferring of the counterweight from the front earthmoving structure to a support bracket 27 carried on the rear portion 28 of vehicle 12. The temporary support of counterweight 10 on the backhoe 25 is illustrated in FIG. 3. In this temporarily supported arrangement, the counterweight may be vertically adjusted by means of hydraulic lines 29 extending from the vehicle to the separated backhoe adapted to selectively adjust stabilizer jacks 30. Thus, the hook 19 of bracket means 16 may be suitably adjusted to engage a support bar 31 of support bracket 27 in mounting the counterweight to the vehicle rear portion 28.

The support bracket 27 further includes an upturned lower hook 32. Bracket opening 22 is disposed to be aligned with the upwardly opening recess 33 defined by hook 32 to receive suitable securing means, such as removable pins 34 or the like, to further secure the counterweight to support bracket 27, as shown in FIG. 4.

To mount the counterweight on support bracket 27, the operator merely brings the vehicle rearwardly from the position of FIG. 3 to engage the counterweight bracket means 16 with the support rod 31. Retracting of the stabilizer jacks 30 may then be caused to effect a transfer of the support from the backhoe 25 to the support bracket 27, as shown in FIG. 4.

Thus, the counterweight structure of the present invention is extremely simple and economical of construction. The use of the two different mounting bracket means 16 and 23 on the counterweight permits a ready mounting of the counterweight selectively to the support means of the drive machine as well as to the temporary supporting means of the backhoe. This structure permits a one-man operation of the apparatus suitably to effect a transfer between the different mounting supports. The use of the hook portions of the mounting bracket means permits a facilitated transfer, minimizing difficulty and time in effecting the selective positioning of the counterweight on the drive machine.

The foregoing disclosure of specific embodiments is illustrative of the broad inventive concepts comprehended by the invention.

I claim:

1. Counterweight structure for use in counterbalancing earthmoving apparatus comprising:

a weight;

first mounting bracket means fixedly associated with said weight;

second mounting bracket means having a configuration differing from that of said first bracket means and fixedly associated with said weight to extend away from said first mounting bracket means;

a first support adapted to be mounted to an earthmoving apparatus and removably support said first mounting bracket means;

a second support adapted to be mounted to the earthmoving apparatus at a position spaced from said first support and removably support said first mounting bracket means; and a transfer support adapted to be carried by a removable portion of the earthmoving apparatus and removably support said second mounting bracket means.

2. The counterweight structure of claim 1 wherein a stop is fixedly associated with the weight adjacent said first mounting bracket means for engaging said first support to position the counterweight in a preselected disposition on said first support.

3. The counterweight structure of claim 1 wherein said first mounting bracket means includes a downturned hook and said first support includes a horizontal bar for removably supporting said hook.

4. The counterweight structure of claim 1 wherein said second mounting bracket means includes a downturned hook and said second support includes a horizontal bar for removably supporting said hook.

5. The counterweight structure of claim 1 wherein said second mounting bracket means extends oppositely to said first mounting bracket means.

6. The counterweight structure of claim 1 wherein said first support swingably supports said first mounting bracket means about a horizontal axis.

7. The counterweight structure of claim 1 wherein each of said mounting bracket means defines a downturned hook at an upper portion of said weight and a lower stop shoulder portion.

8. The counterweight structure of claim 1 wherein said first mounting bracket means defines a pair of horizontally spaced downturned hooks.

9. The counterweight structure of claim 1 wherein said second mounting bracket means defines a pair of horizontally spaced downturned hooks.

10. The counterweight structure of claim 1 wherein said second support includes removable pin means for supporting said first mounting bracket means, and fixed pin means for positioning said first mounting bracket means when supported on said removable pin means.

* * * * *